US010398193B1

(12) United States Patent
Cheskin

(10) Patent No.: US 10,398,193 B1
(45) Date of Patent: Sep. 3, 2019

(54) ELECTRICALLY CONDUCTIVE FOOTWEAR UTILIZING EARTHING TECHNOLOGY FOR ENHANCING HUMAN PERFORMANCE

(71) Applicant: Melvyn Cheskin, Boca Raton, FL (US)

(72) Inventor: Melvyn Cheskin, Boca Raton, FL (US)

( * ) Notice: Subject to any disclaimer, the term of this patent is extended or adjusted under 35 U.S.C. 154(b) by 0 days.

(21) Appl. No.: 16/032,508

(22) Filed: Jul. 11, 2018

(51) Int. Cl.

| | |
|---|---|
| ***A43B 7/36*** | (2006.01) |
| ***A43B 3/00*** | (2006.01) |
| ***A43B 13/04*** | (2006.01) |
| ***A43B 9/02*** | (2006.01) |
| ***A43B 13/32*** | (2006.01) |

(52) U.S. Cl.
CPC ..... *A43B 7/36* (2013.01); *A43B 3/001* (2013.01); *A43B 9/02* (2013.01); *A43B 13/04* (2013.01); *A43B 13/32* (2013.01)

(58) Field of Classification Search
CPC ..... A43B 7/36; A43B 3/001; H05F 3/02
USPC ..... 361/223
See application file for complete search history.

(56) References Cited

U.S. PATENT DOCUMENTS 7,424,782 B2 * 9/2008 Cheskin ..... A43B 7/36 36/32 R

* cited by examiner

*Primary Examiner* — Ronald W Leja
*Assistant Examiner* — Christopher J Clark
(74) *Attorney, Agent, or Firm* — Melvin K. Silverman

(57) ABSTRACT

A shoe for enhancing human performance and improving health by establishing a two-way electrical conduit between body and ground by way of a conductive rubber outsole material of a shoe. A resilient conductive element is integral with the outsole and extends along a heel of the shoe upper along its outer surface. An electrical tape or similar material extends into the interior of the shoe and contacts a conductive sock liner. The conductive tape or similar material may be placed over a non-conductive sock liner so as to contact the foot directly. The foot is in constant electrical connection with the conductive outsole via the tape, which may contain a lighted element on the outside of the shoe. A conductive sock or hose may be employed to provide lower resistant electrical path to the ground. The resistance range of the conductive materials used should be between 100 resistance ohms and 100,000 resistance ohms to ensure collection of beneficial free electrons from the earth's surface and dissipate harmful EMF's and static electricity from the human body.

20 Claims, 4 Drawing Sheets

ELECTRICALLY CONDUCTIVE FOOTWEAR UTILIZING EARTHING TECHNOLOGY FOR ENHANCING HUMAN PERFORMANCE

FIELD OF THE INVENTION

The present invention relates to footwear containing electrically conductive components and, more particularly, to an integral shoe design having electrically conductive components, within a specific resistance range, for providing an electrical conduit between the user's foot and the ground for enhancing human physical performance.

DESCRIPTION OF THE RELATED ART

The instant invention is an improvement of the inventor's U.S. Pat. No. 7,424,782 B2, "Electrically Conductive Shoe and System" (2008). The invention more particularly relates to efficient means of providing a path of electrical conduction, at lower resistance, between the outsole of the shoe and the foot of the user and, as well, relating to a conductive sock particularly adapted for use therewith.

One form of prior art exists in U.S. Pat. No. 3,459,997 (1969) to Leggie, wherein contemplates a body grounding device composed of a single elongated strip of conductive material disposed under the shoe from the heel to toe and, in fact, extending over and doubling back over the toe with an elastic toe strap within the doubled-back portion of the strip, thereby preventing the strap from contacting the floor and possibility becoming ensnarled with objects on the floor. The tread member is held flat under the sole and heel of the wearers shoe due to the provision of a conductive heel insert removably secured thereto. Alternatively, the heel insert may be replaced by a conductor leg band serving the same end. The safety of the wearer of the device in the improved form is thus better assured. One object of the invention is to provide an improved body grounding device which is economical to produce and safe to wear.

A further art of the invention is U.S. Pat. No. 3,800,447 (1974) to Pass. The device comprises a sole, a strap secured to the sole to receive the lower part of the foot of the wearer and hold same in position on the sole, and electrostatic grounding tape connecting the shoe or foot of the wearer to the underside of the sole.

U.S. Pat. No. 5,448,840 (1995) of the Inventor, entitled Shoe Containing Electrically Conductive Integral Elements. The invention more particularly relates to efficiently providing a path of electrical conduction between the outsole of the shoe and the foot of the user and, as well, relates to a conductive sock particularly adapted for use therewith.

Typically, shoes are completely constructed with electrically non-conductive components or, they are partially constructed with components that do not provide an electrical conduit between the wearer's foot and the ground. The wearer's foot is typically insulated from the ground, particularly in athletic footwear, where the shoe sole is typically constructed with non-conductive rubber or other polyurethane or synthetic soling material.

Also U.S. Pat. No. 5,786,977 (1998) to Cohen shows an art for electrostatically grounding a person working in an electronic factory or other area where static electricity in persons is a problem. There is an electrostatic drain to drain static electricity to ground from a predetermined region from the person to a predetermined region for making of electrical connection to the drain means and for conduction of static electricity to it. The assembly is an electrically conductive tab, a thin flexible synthetic resin substrate, a conductive film on the substrate, a discrete high-resistance resistor mounted on the film and having its terminal portion electrically connected to spaced and mutually electrically isolated regions of the film. An end of the tab is electrically to the conductive film. An end of the tab is electrically connected to the conductive film and a package formed of thin electrically-insulating water-resistant flexible sheet material is provided. The sheet material encloses the resistor and at least a large part of the substrate.

Other art is that of U.S. Pat. No. 7,055,266 (2006) to Elsey which provided an electrostatically dissipative athletic shoe. The shoe includes an outsole, a midsole, and an insole. The insole is preferably formed of a nylon fabric material. The insole is stitched with an electrically conductive thread in a zig-zag pattern, and electrically conductive glue is provided between the insole and the midsole and is disposed so as to make contact with the ESD thread. Preferably, the midsole includes at least two spaced-apart holes therethrough and an electrically continuous loop of ESD thread passes loosely through the holes and across opposite top and bottom surfaces of the midsole. Preferably ESD glue is provided between the outsole and the midsole and is disposed so as to make contact with the loop. Preferably, the shoe includes a sockliner that is also stitched with an electrically conductive thread in a zig-zag pattern, and electrically conductive glue is provided between the sockliner and the insole and is disposed so as to make contact with the ESD thread of the sockliner and the ESD thread of the insole.

Yet further is U.S. Patent Publication No. 2011/0030243 (2011) by Tersigni. Therein, the present invention refers to a conductive, resistive anti-triboelectric footwear made of a footwear bod cut, a semiconductor sole, a resistive conductive insole, common insole, a bottom of sole having contacting the made of the same material as the unloading device and semiconductor insole and unloading devices, with the pose of contacting the human body with the ground achieve the release of the stored static electricity on which footwear body is fixed, characterized in that the unloading devices pass through the common insole and the foot bottom making contact between the resistive conductive insole and the ground at least through the portion or the whole sole when it is resistive conductive; and its manufacturing method.

Also, U.S. Pat. No. 9,538,812 (2017) to Kek Kow at ESD Technology Consulting & Licensing Co., Ltd. Shenzhen, Guangdong, China teaches an electrostatic discharge shoe grounding accessory comprises an attachment mechanism and fastening mechanism, wherein, the attachment mechanism is a U-shaped holder to the back wall of an opening rim of the shoe, and the fastening mechanism includes at least one smaller loop through which a front portion of the shoe is hitched. An electrostatic discharge shoe assembly comprises a shoe and the electrostatic discharge shoe grounding accessory.

The inventor's previous invention U.S. Pat. No. 7,424,782 B2 (2008) sought to improve upon technology for improving human health that is utilized in the prior art above. The prior art employs the well-established scientific principle of "electrostatic discharge" (ESD) grounding. ESD stands for the proposition that when two objects come into contact, there is a dissipation of static electricity. From a perspective of humans in contact with the ground, ESD grounding demonstrates that the foot of the human creates an electrical connection and "grounds" the human to a ground surface of which the foot contacts. By grounding the human with a ground surface, the human body becomes protected from the buildup of static electricity and the connection made with the ground dissipates harmful EMFs from the body. ESD technology uses an electrical conduit that creates the proper resistivity, in the range of $10^6$ to $10^8$ resistance ohms. The significance of this resistivity is that it doesn't allow low enough resistivity for the body to conduct electricity, but instead it allows for the dissipation of electricity from the body; still allowing a slow, more restricted movement of electrons between the body and the ground. U.S. Pat. No. 7,424,782 B2 (2008) stood for a different proposition, to take this technology into the realm of conductivity and out of dissipation.

It did so by using materials of a lower resistivity in the range of $10^3$ to $10^6$ resistance ohms, from the edge of the conductivity range to the edge of grounding ranges. By flowing electricity into the body through conduction, the muscles become stimulated, therefore enhancing performance. The present invention seeks to challenge even lower resistivity ranges from the edge of shielding to the middle of conductivity, $10^2$ to $10^5$ resistance ohms, by a phenomenon known as "Earthing". Earthing is a form of ESD grounding, but where it can be distinguished is in the speed of electron transfer due to the inherently lower resistivity associated with Earthing materials. The theory behind Earthing is that closer contact to the ground, being barefoot, allows for an electrical energy to flow into the body and this has been associated with health benefit; the benefit is that of the balancing of charge within the body. When the body is lifted off the Earth contact is no longer being made, the body is then susceptible to carrying positive voltage relative to the Earth and it is believed by some that this has negative effects on the body. By creating a grounded connection with low resistivity, the free flow of electrons into the body allows for a balance of charge, lowering the voltage potential in the body to ideally get the voltage as close to zero as possible, if not getting to a full balanced zero.

As such, It is an object of this present invention, as was in the previous, to use this technology to enhance human performance in ways that ESD does not and doing so at very low resistance.

SUMMARY OF THE INVENTION

A shoe for enhancing human performance and improving health by establishing a two-way electrical conduit body and ground by way of a conductive outsole material or a shoe. A resilient conductive element is integral with the outsole and extends along a heel of the shoe upper along its outer surface. An electrical tape or similar material extends into the interior of the shoe and contacts with a conductive sock liner. The conductive tape or similar material may be placed over a non-conductive sock liner so as to contact the foot directly. The foot is in constant electrical connection with the conductive outsole via the tape, which may contain a lighted element on the outside of the shoe. A conductive sock or hose may be employed to provide lower resistant electrical path to the ground. The resistance range of the conductive material used should be between 100 resistance ohms and 100,000 resistance ohms to ensure collection of beneficial free electrons from the earth's surface and dissipate harmful EMF's and static electricity from the human body.

According to a presently preferred embodiment of the invention, the outsole is conductive and is electrically coupled to conductive tape that extends upwardly from the outsole in the counter, or heel, portion of the shoe. The conductive tape extends into the interior of the shoe and makes contact with an electrically conductive sock liner. The sock liner provides complete contact with the wearer's foot regardless of the foot's orientation within, for example, the shoe while jumping, stepping off or landing.

In another aspect of this embodiment, the outsole can be formed having a conductive extension up the counter, in contact with the counter stiffener on the shoe upper. The stiffener can be made of a conductive material and contact the conductive tape.

Alternatively, the tape can extend into the shoe at a mid-portion between the sole and the shoe opening. This aspect has the benefit of reducing the length of tape required to contact the conductive insole.

In another aspect of the invention, the conductive outsole can extend upwardly and directly contact the conductive tape that extends into the inner portion of the shoe.

Providing a conductive sock liner provides a more substantial connection between the wearer's foot and the conductive path so that an electrical charge from the environmental substrate can pass through the conductive outsole to the wearer to enhance the performance of the wearer.

Accordingly, it is an object of the present invention to provide a rugged integral footwear design which can control the dissipation of electrical charges between the body and the environmental substrate that the footwear normally makes contact with.

It is a further object to provide a shoe construction that brings a portion of the shoe that makes substantial contact with the ground during normal use, such as outsole, into direct electrical contact with the human body.

It is another object of the invention to provide a shoe that can improve human physical performance by harnessing the electrical force in the earth with the body's electrical energy.

A final object of the invention is to ensure the resistance range of the conductive material used is between 100 resistance ohms and 100,000 resistance ohms to safely maximize the capturing of free flowing electrons from the ground into the body.

The above, and other objects, features and advantages of the invention will be apparent in the following detailed description of exemplary embodiments of the invention which are to be read in connection with the accompanying drawings herein.

DETAILED DESCRIPTION OF THE INVENTION

Figure 1:
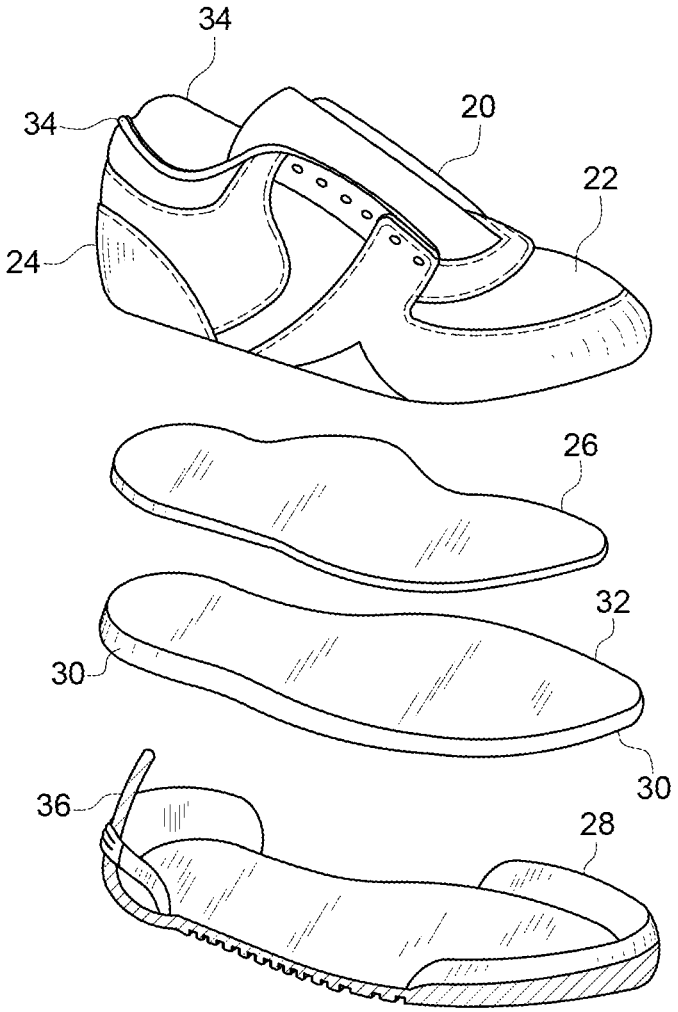
FIG. 1 is an exploded view of the present invention showcasing the upper, sock liner, insole, midsole, and outsole of a shoe.
Figure 2:
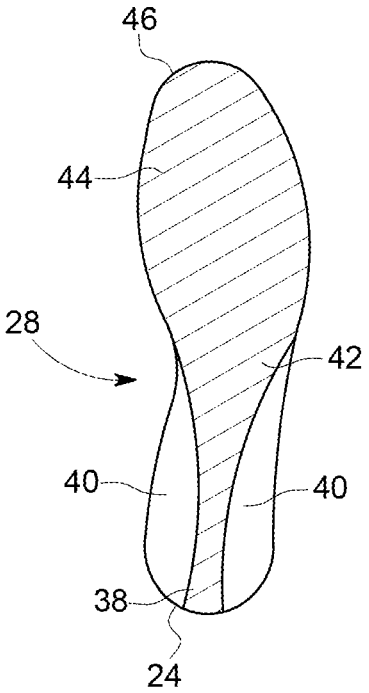
FIG. 2 is a schematic view the underside of an embodiment the present invention.

Looking to FIG. 1, an exploded view of the present invention is shown comprising a non-electrically conductive upper portion 20, a conductive sock liner 26, a non-electrically conductive midsole 30, and an electrically conductive outsole 28. Along the upper portion, many components to the shoe can be seen. More specifically the counter 24 which is the heel portion of the shoe, the collar 34 which is the portion which generally fits around the ankle of the wearer, and the shoe's forepart 22 which fits around the toes of the wearer. It is not an essential part of this invention to have the upper portion 20 be constructed out of a conductive material, therefore it is to be constructed out of any material which is suitable, and desirable for specific shoe construction. For example, leather materials, nylons, and polymers are materials which have been historically used in shoe construction. Below the upper portion of the shoe sits the conductive sock liner 26, below the conductive sock liner 26 sits the non-conductive midsole 30, and on the bottom, sits the outsole 28. The midsole 30 can be constructed made of a variety of materials. In athletic footwear, the midsole 30 provides shock absorption, comfort, and spring capability due to its resilience for enhancing physical performance by the wearer.

The outsole 28 as shown in FIGS. 1-6, is the main conductive element in the present invention. The overall structural design of the outsole can be configured in a variety of ways depending on the shoe type and activity that the shoe is designed for. As shown in a bottom sole outline in FIG. 2, the outsole 28 extends along at least a major portion of the length of the bottom-most surface of the shoe from the toe area 46 to the heel portion 24, beginning at a point proximate the ball of the foot and extending to the heel portion 24 of the foot. The electrically conductive material may comprise the entire outsole, or it may be proportionally smaller than the entire outsole 28 in order to define marginal non-conductive areas 40 that would not normally make contact with the ground. The sole pattern illustrated in FIG. 2 therefore includes an electrically conductive portion 44 (shown in lined outline) that has a substantially widened forward section under a forepart of the foot, a narrow instep section 42 and a narrow heel portion 38. This configuration has been found to be useful for court sports such as basketball o racquetball. The greater surface area is provided at the forepart of the foot so that conductivity can be transmitted to the push-off or jumping part of the foot.

Figure 3:
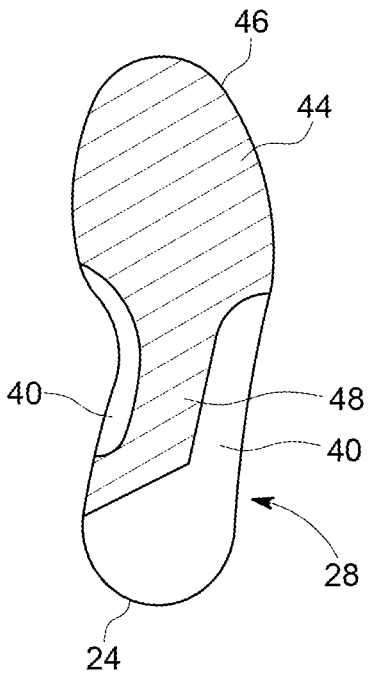
FIG. 3 is a schematic view of the underside of another embodiment of the present invention.

In another embodiment of the outsole 28, shown in FIG. 3, a typical pattern of shoe outsole conductive portions 44 (shown in lined outline) for a shoe is designed primarily for running and walking. The electrically conductive elements conform in general shape to the forward portion under the forepart of the foot with a narrower instep portion 48 being defined under the arch of the foot, having non-conductive areas 40.

Generally, the conductive outsole 28 is made from a rubber or rubber-like material, referred to herein as an elastomer. The term "elastomer" is meant to encompass materials including natural and synthetic rubbers possessing characteristic elastic properties, and/or any substances, including mixture containing natural rubber, that have rubber-like qualities. The outsole 28 is typically formed of carbon rubber and styrene-butadiene rubber. Black carbon rubber is the hardest wearing rubber and is preferably used in shoe constructions designed for running. Styrene-butadiene rubber is preferably used for flat-soled shoes for use in tennis and basketball. Other elastomeric materials useable in shoes according to the invention are disclosed within Cheskin et al., in "The Complete Handbook of Athletic Footwear"; Fairchild Publications, New York, (1987) pages 135-137, incorporated herein by reference and include Neoprene polychloroprene elastomers.

The outsole 28, is preferably molded from one of the elastomers described above and is formed as a mixture incorporating electrically conductive materials. The conductive material is typically carbon particles, but can be any other electrically conductive material such that the distribution of the conductive material in the rubber elastomer outsole material is sufficiently concentrated and homogeneous to provide an ohmic path between the foot and the ground having a resistance of between about $10^2$ and about $10^5$ ohms-cm. Stainless steel particles, and other metallic powders such as zinc oxide, or graphene for example, can be used with the elastomeric outsole materials. In preferred embodiments of the invention, conductive particles in combination with the elastomeric material of the outsole 28 provide a volume resistivity sufficient to provide an overall resistance from foot to ground through the outsole in the target range. The resistivity values refer to conventional bulk or volume resistivity measurements which define current flow per unit area through a volume of material.

Figure 5:
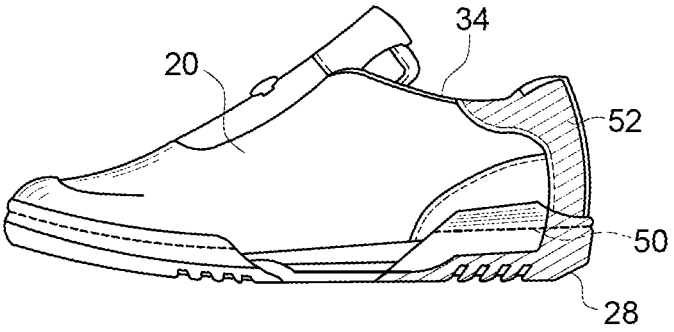
FIG. 5 is a schematic side view of the overall present invention in the same embodiment of FIGS. 3 and 4.
Figure 6:
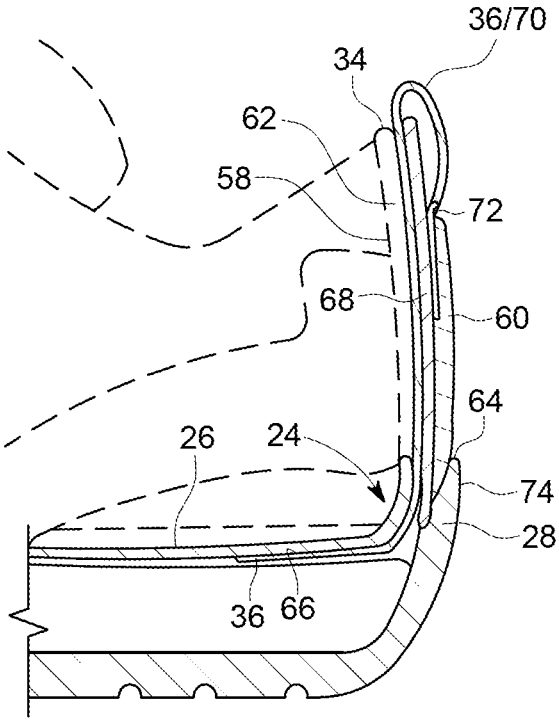
FIG. 6 is a focused side view of the rear portion of the present invention.

It is the object of this invention to create a conductivity directly from the ground surface that is contacting the conductive outsole 28 and feed that electricity through the shoe by a conductive tape 36 into the conductive sock liner 26, as seen in FIG. 5. It now becomes clear that the present invention relies heavily on contact, and in a preferred embodiment the conductive sock liner 26 is what facilitates electrically conductive contact along the sole of the wearer's foot, as seen in FIGS. 1 and 6. Looking closely at FIG. 6, the conductive tape 36 is placed In contact with the conductive sock liner 26 at the heel of the sock liner, indicated at 66. The conductive tape extends up the heel along the interior surface of counter 68.

The conductive tape 36 is securely mounted to the counter 24 along at least a substantial portion of its length. This maintains the tape's contact with the shoe, and provides good conduction for transferring electrical energy from the ground to the wearer.

As is well known to one skilled in the art, the counter 24 provides rigidity and stability in the rear portion of the shoe, and is typically constructed of a rigid plastic or hard cardboard material. At the upper portion of the counter, the tape may protrude from the interior of the shoe and form a loop 70. The conductive tape is secured to the outside of the counter by a counter cover 60 that can be stitched to the counter, as shown at 72, or the two portions can be integrally molded. Alternatively, the counter cover 60 may be affixed to the counter 24 by an adhesive material. The counter cover is constructed of rubber with conductive particles disposed therein.

The conductive counter cover 60 is attached to the outsole 28 at a conductive outsole tab 64 that extends upwardly along a heel of the shoe. As shown, the conductive counter cover 60 is disposed underneath the tab 64. However, as would be apparent to those skilled in the art, the conductive outsole tab 64 can be disposed inside the counter cover. Additionally, it may be connected by any suitable means. If the conductive cover 60 is connected to the conductive outsole 28 at 74 by means of an adhesive, the adhesive may be conductive so that the electrical connection between the outsole and the cover is maintained. Alternatively, the conductive tape may extend down to the conductive outsole and contact the outsole directly.

This tape provides an electrical conduit between the outsole 28 and the sock liner 26 and also has the strength to withstand pulling or tension. The ability to withstand tension is particularly well suited for this embodiment in that the tab 70 can be used to facilitate putting the shoe on a wearer's foot by pulling from the tab's loop.

The conductive tape may be disposed between the inner shoe padding 58 at the counter pocket 62 and the counter 24. When so disposed, it is protected from the rubbing motion of a wearer's foot as the shoe is put on and taken off. The conductive tape 36 may be stitched at the uppermost portion of the inner padding, at the collar 34. If the conductive tape is disposed between the inner padding 58 of the shoe and the counter 24, the tape passes down the inside surface of the counter 68 to a location adjacent the conductive sock liner 26. The tape 36 extends a sufficient distance along the upper surface of the midsole and the lower surface of the sock liner 26 to provide good electrical contact between the conductive sock liner and the tape.

In a preferred embodiment, the tape extends two and one half inches along the bottom of the shoe. As will be apparent to those skilled in the art, the tape may extend a greater or lesser distance inside the shoe depending on specific characteristics of material that is chosen. The conductive sock liner is constructed of an EVA "carbonated" material having a woven laminate covering. The woven laminate covering includes a conductive metallic thread woven in the fabric. The laminate covering covers the plantar engaging surface of the sock liner 26. A conductive adhesive may be used to adhere the laminate covering.

The conductive sock liner 26 and conductive tape 36 are to also be selected from materials in the resistance range of the conductive material used is between 100 resistance ohms and 100,000 resistance ohms to safely maximize the capturing of free-flowing electrons from the ground into the body. In an embodiment where a sock liner 26 is not included in the design, an electrically conductive insole 32, as seen in FIG. 1, is connected as a part of the top side of the non-conductive midsole 30. It is conceivable that a wearer of the shoe may seek to replace the conductive sock liner 26 with a custom fit orthotic insert, but this type of insert may not be constructed of conductive material. A solution to this issue can be demonstrated with the repositioning of the conductive tape 36 to be laid over the custom fit orthotic insert as to remain in contact with the bottom of the wearer's foot.

Figure 4:
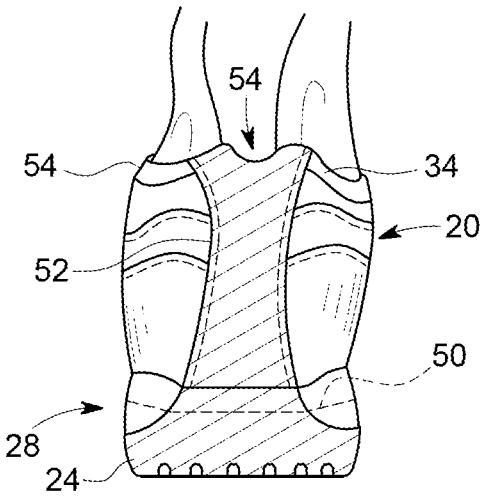
FIG. 4 is a backside view of the present invention in the same embodiment of FIG. 3.

In a further embodiment where there is not conductive tape 36 to provide an electrical conduit between the environmental substrate and the wearers body, an integral extension 52, as shown FIG. 4, extends upwardly from the bottom of the outsole to make contact with the body. The integral extension may be formed of one piece with the outsole. Alternatively, the extension may be formed separately and then securely attached to the outsole. In one preferred embodiment, the integral extension 52 extends from the outer edge periphery of the outsole 28 up to the shoe collar 34 where it contacts the wearers foot or sock.

In the embodiments shown in FIG. 5 the outsole 28 is shown with stippling to schematically represent conductive particles dispersed throughout the rubber outsole material and the conductive extension 52 is shown in lined outline. As described herein, the extension may be integrally formed with the outsole, for example, by molding as a unitary extension of the normal outsole pattern. Alternatively, the extension may be made unitary with the outsole by welding a separately molded extension 52 onto a separately molded outsole by conventional methods, wherein the separate outsole and separate extension are overlapped and melted together and then re-solidified to form a unitary overlapped area.

The extension 52 and the outsole 28 may alternatively be made integral with each other by stitching 50 the two overlapping portions together such that the separate components are in structurally permanent and integral conductive contact with each other. In a preferred embodiment the extension 52 comprises the same rubber material, including the same conductive particles or other material dispersed in its rubber matrix as the outsole. In any event, the bulk or volume resistivity of the extension 52 is in the same preferred range as the outsole 28. Most preferably the volume resistivities of the two are the same.

Figure 7:
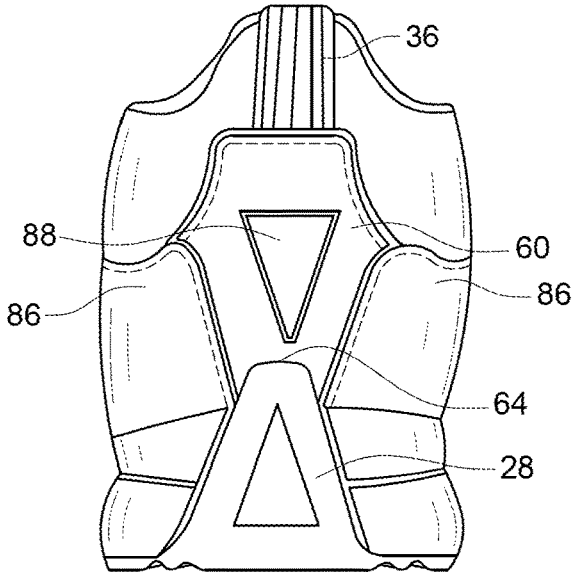
FIG. 7 a backside view of the present invention in an embodiment utilizing a lighting element.

FIG. 7 is rear views of two alternative embodiments of the present invention. Conductive tape 36 is connected to the conductive outsole 28 by means of a counter cover 60. The counter cover, as shown in FIG. 7 is disposed at the heel of the shoe and various shoe upper components 86 are stitched to the counter cover. One might be wondering from time to time if they are "earthed" or "grounded" in conductivity with the ground surface. To provide peace of mind to the wearer, the embodiment in FIG. 7 shows a lighting element 88, preferably an LED strip, that will be electrically connected via wire to the conductive tape 36. When the shoe is in contact with a ground surface and there is flow of charge the lighting element 88 will illuminate.

Figure 8:
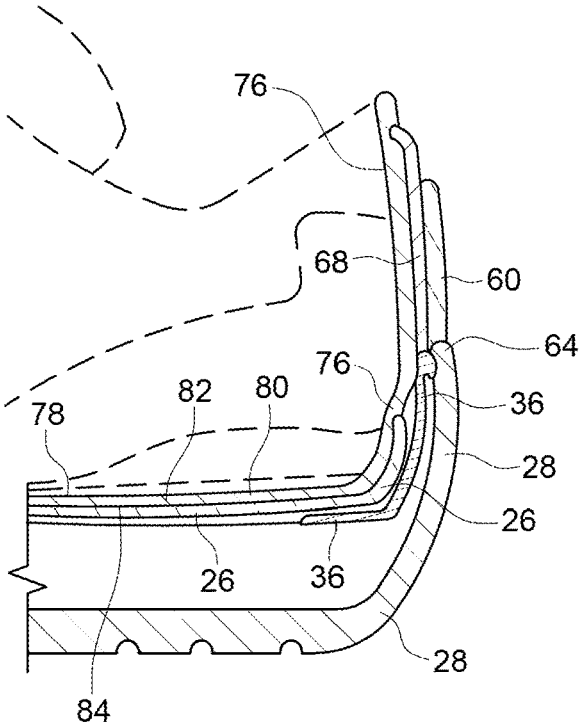
FIG. 8 is a focused side view of the rear portion of another embodiment of then present invention where the wearer uses a conductive sock.

Looking to another embodiment, the cross-sectional breakaway view of FIG. 8, it is to be appreciated that the above described shoe with integrally conductive elements may be advantageously used with a conductive sock or hose 76 including a plantar surface 78 which, through means such as knitting, weaving, or implantation, is provided with conductive fibers 80 to preclude any possible insulative function of such surface. The resultant conductivity of the sock 76 is preferably in a range of $10^2$ to $10^5$ ohms between opposing sides of plantar surface 78. The anti-static conductive-fiber plantar surface may be formed integrally, along an interface 82 within a lower region 84 of an otherwise conventional sock. It is to be appreciated that the conductive fibers 80 preferably extend through the entire thickness of the sock, thereby assuring conductive contact between a foot of the use and sock liner 26 of the conductive shoe. Electrical communication between the plantar surface and adjacent areas of the foot of the user and the insole of the conductive shoe is thereby assured. Therein, any potential insulative barrier that would otherwise be formed by the sock is eliminated, regardless of the thickness thereof.

It should be understood that there exist a number of fibers suitable for use with the inventive sock 76, these including fibers of cotton, acrylic, nylon, LYCRA (a DuPont trademark), wool, polyester, silk and polypropylene. Such fibers preferably exhibit a thread density in a range of 15 to 50 per lineal centimeter.

It is noted that while existence of individual fibers having a conductivity in the above range are known in the art, the effect of integration of such prior art fibers into known materials of the above set forth would be of fabric having only 1 to 2 percent by weight of the entire fabric. Thereby, the actual electrical resistance of the sock that would result from such a process would be too great to achieve an electrical path, through the plantar surface of the sock, having a conductivity in the desired range. Accordingly, the conductive sock 76 will require either a high percentage fibers of appropriate conductivity or a smaller percent of fibers having a much greater conductivity such that the aggregate bulk effect upon the entire plantar surface of the sock will be sufficient to produce an average conductivity between opposing surfaces in a range $10^2$ to $10^5$ ohms.

The electrical conduit created between the wearer's foot and the ground imparts a greater ability in the wearer to perform physical tasks relative to the same wearer wearing a shoe which does not provide such an electrical conduit. The following experiments demonstrate a significant increase in physical performance when wearing a shoe according to the invention. In each of the following described experiments the subjects, performances of physical exercises were carried out first on a non-conductive surface and then while standing, wearing only socks, on a sheet of conductive rubber according to the invention. The conductive conduit created between the wearer's foot and the ground by standing on a sheet of outsole conductive rubber is the same as is created when the wearer is wearing any shoe embodiment according to the invention. This was confirmed by measuring the conductivity between the foot and ground of a person standing on a sheet of outsole conductive rubber according to the invention and of the same person standing in a shoe having a mock up design most similar to the FIG. 6 embodiment with a conventional dissipative tester, such as a model FT-2630 FOOTWEAR TESTER, available from Plastic Systems, Inc., Marlborough, Mass., at a setting of $10^6$ ohms. In the following experiments (1) a sheet of rubber containing 40 parts of XC-72 carbon black (available from Cabot Corporation of Boston, Mass.) per hundred parts of rubber, and: (2) a sheet containing 40 parts of N.550 carbon black (Cabot Corporation) per hundred parts of rubber, were used as the conductive rubber components. The conductive rubber sheet was measured for volume resistivity and found to have a volume resistivity of about 37.5 ohms-cm. The ohmic path between a person and the ground was measured with the person standing on a copper ground plane and holding a copper bar connected to a positive electrode at chest level. Standing on the ground plane in non-conductive rubber outsoled shoes, no conductivity could be recorded. Standing with socks only on the ground plane a resistance of 90,000 ohms was measured. Standing in socks on the test sheet of conductive rubber which in turn was lying on top of the ground plane, a resistance of 195,000 ohms was measured.

As it has been reflected in other parts of this application, it is an object of this invention to enhance overall human performance, more specifically in athletics. In the following example, the physical performance comparisons in the form of reflex response time were made using a single subject, tested with both a grounded/earthed subject and a non-grounded/earthed subject.

EXAMPLE

The parameters of the test were measuring reflex response time by having the female test subject place her foot on a switch, while watching a digital time display. A prompt on the display was shown at unpredictable times for the test subject to trigger the switch and record the response time between the prompt and switch trigger. The tests were taken across three different days in the span of a month, some tests the subject grounded/earthed at the higher end of "Earthing" resistance of 100,000 resistance ohms, and some tests the subject was insulated at 100,000,000,000 resistance ohms. The average response time was recorded in 1/100ths of a second. The grounded/earthed tests produced reaction times: (Day 1) 26.25 and 24.03, (Day 2) 25.07 and 24.8, and (Day 3) 24.5, 24.6, and 24.2. The insulated tests produced reaction times: (Day 1) 28.3, 29.5, (Day 2) 29.5, 29.1, and (Day 3) 25.5, 27.08, and 26.75. The average decrease in reaction time is calculated to be 3.17 hundredths of a second, demonstrating an increase reaction time.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

I claim:

1. A shoe for conducting a two-way electrical conduit between body and ground, comprising:

(a) a non-electrically conductive upper portion for at least partially surrounding a wearer's foot;

(b) a non-electrically conductive midsole component;

(c) a conductive sock liner contacting with a sole of the foot of said wearer;

(d) an electrically conductive shoe outsole rigidly and non-removably affixed below said non-electrically conductive midsole layer and to said upper portion, said outsole forming a bottom shoe surface having substantial contact with the ground, said outsole having electrical resistance in a range between 100 resistance ohms and 1,000 resistance ohms, ensuring two-way electrical connection between the foot and the ground;

(e) said electrically conductive sock liner positioned inside of said upper portion of the shoe;

(f) a conductive tape, a substantial part of which is sewn or rigidly mounted to said upper portion, providing two-way electrical communication between said outsole and conductive sock liner, said conductive tape extending between or around a back counter pocket forming a loop above a heel of said upper portion of the shoe between a counter cover and an interior counter of said shoe.

2. The shoe as recited in claim 1, in which said conductive outsole further comprises:

a tab extending onto a heel portion, the tab electrically coupled to a conductive material inside the shoe.

3. The shoe as recited in in claim 1, further comprising:

said conductive outsole integrally attached to said counter cover, the counter cover constructed of said conductive material, and material electrically sewn or coupled to the counter cover.

4. A shoe as recited in claim 1, in which said conductive tape further comprises:

an electrical communication between said outsole and said conductive sock liner said tape extending along an outer surface of the shoe and into the shoe between interior padding and said counter, and downwardly to said sock liner.

5. The shoe as recited in claim 1, in which said conductive tape communicates with said conductive sock liner in the electrically resistance level in a range between 100 resistance ohms and 1,000 resistance ohms at a bottom surface thereof.

6. The shoe as recited in claim 1, in which the conductive tape extends to a heel portion of the shoe and sewn or rigidly and non-removably fixed to a counter-cover of the shoe.

7. The shoe as recited in claim 1, in which said counter cover includes an opening allowing said conductive tape to pass therethrough from said outside of the shoe to the inside thereof.

8. The shoe as recited in claim 1, further comprising:

the electrically conductive tape extending from the conductive outsole to the counter cover and passing through an opening in the counter pocket and extending into the interior of the shoe.

9. The shoe as recited in claim 1, in which said tape may contain a lighted element to indicate the electrical connection thereof intact.

10. The shoe as recited in claim 1, further comprising:

an electrically conductive sock contacts said conductive sock liner.

11. A shoe for conducting a two-way electrical conduit between body and ground, comprising:

(a) a non-electrically conductive upper portion for at least partially surrounding a wearer's foot;

(b) a non-electrically conductive midsole component;

(c) a conductive insole contacting with a sole of the foot of said wearer;

(d) an electrically conductive shoe outsole rigidly and non-removably affixed below said non-electrically conductive midsole layer and to said upper portion, said outsole forming a bottom shoe surface having substantial contact with the ground, said outsole having electrical resistance in a range between 100 resistance ohms and 1,000 resistance ohms, ensuring two-way electrical connection between the foot and the ground;

(e) said electrically conductive insole positioned inside of said upper portion of the shoe;

(f) a conductive tape, a substantial part of which is sewn or rigidly mounted to said upper portion, providing two-way electrical communication between said outsole and conductive insole, said conductive tape extending between or around a back counter pocket forming a loop above a heel of said upper portion of the shoe between a counter of cover and an interior counter said shoe.

12. The shoe as recited in claim 11, in which said conductive outsole further comprises:

a tab extending onto a heel portion, the tab electrically coupled to a conductive material inside the shoe.

13. The shoe as recited in in claim 12, further comprising:

said conductive outsole integrally attached to said counter cover, the counter cover constructed of said conductive material, and material electrically sewn or coupled to the counter cover.

14. A shoe as recited in claim 12, in which said conductive tape further comprises:

an electrical communication between said outsole and said conductive insole, said tape extending along an outer surface of the shoe and into the shoe between interior padding and said counter, and downwardly to said conductive insole.

15. The shoe as recited in claim 12, in which said conductive tape communicates with said conductive insole in the electrically resistance level existing within a range between 100 resistance ohms and 1,000 resistance ohms at a bottom surface thereof.

16. The shoe as recited in claim 12, wherein the conductive tape extends to a heel portion of the shoe and sewn or rigidly and non-removably fixed to a counter-cover of the shoe.

17. The shoe as recited in claim 11, wherein the conductive tape extends to a heel portion of the shoe and sewn or rigidly and non-removably fixed to a back counter portion of the shoe.

18. The shoe as recited in claim 12, further comprising:

the electrically conducive tape extending from the conductive outsole to the counter cover and passing through an opening in the counter pocket and extending into the interior of the shoe.

19. The shoe as recited in claim 12, wherein said tape may contain a lighted element to indicate the electrical connection thereof intact.

20. The shoe as recited in claim 12, in which an electrically conductive sock contacts said conductive insole.

* * * * *